US008441407B2

(12) United States Patent
Wong et al.

(10) Patent No.: US 8,441,407 B2
(45) Date of Patent: May 14, 2013

(54) MOBILE COMMUNICATION DEVICE

(75) Inventors: Kin-Lu Wong, Hsichih (TW); Cheng-Tse Lee, Hsichih (TW)

(73) Assignee: Acer Incorporated, New Taipei (TW)

( * ) Notice: Subject to any disclaimer, the term of this patent is extended or adjusted under 35 U.S.C. 154(b) by 568 days.

(21) Appl. No.: 12/554,904

(22) Filed: Sep. 5, 2009

(65) Prior Publication Data

US 2010/0309063 A1 Dec. 9, 2010

(30) Foreign Application Priority Data

Jun. 6, 2009 (TW) ..... 98118973 A

(51) Int. Cl.
*H01Q 1/48* (2006.01)
*H01Q 1/24* (2006.01)

(52) U.S. Cl.
USPC ..... 343/846; 343/702

(58) Field of Classification Search ..... 343/700 MS, 343/702, 767, 770, 846
See application file for complete search history.

(56) References Cited

U.S. PATENT DOCUMENTS 6,750,821 B2 6/2004 Fang et al.
7,209,087 B2 * 4/2007 Tang et al. ..... 343/702
7,397,439 B2 * 7/2008 Kanno et al. ..... 343/767
2004/0125029 A1 * 7/2004 Maoz et al. ..... 343/702
2007/0063901 A1 3/2007 Tang et al.
2007/0159401 A1 * 7/2007 Baliarda et al. ..... 343/702
2008/0100514 A1 * 5/2008 Abdul-Gaffoor et al. .... 343/702
2008/0143612 A1 * 6/2008 Iwai et al. ..... 343/702

FOREIGN PATENT DOCUMENTS

CN 101099267 1/2008
WO WO2008084273 A2 * 7/2008

OTHER PUBLICATIONS

"First Office Action of China counterpart application" issued on Jun. 7, 2012, p. 1-p. 5, in which the listed references were cited.

* cited by examiner

*Primary Examiner* — Robert Karacsony
(74) *Attorney, Agent, or Firm* — Jianq Chyun IP Office

(57) ABSTRACT

The present invention is related to a mobile communication device. The device comprises a dielectric substrate, a first ground plane, an antenna element, a second ground plane, and an equivalent band-stop circuit. The first ground plane is disposed on the dielectric substrate. The antenna element is disposed on the dielectric substrate or nearby the dielectric substrate and is connected to a signal source disposed on the dielectric substrate. The second ground plane is disposed nearby one edge of the first ground plane and is connected to the first ground plane through a metal strip. The equivalent band-stop circuit is disposed on the second ground plane and includes a slit and a capacitive element. The open end of the slit is near the metal strip. The capacitive element is mounted across the slit.

10 Claims, 5 Drawing Sheets

MOBILE COMMUNICATION DEVICE

BACKGROUND OF THE INVENTION

1. Field of the Invention

The present invention relates to a mobile communication device, and in particular to a mobile communication device capable of reducing the effect upon the built-in antenna thereof by the ground plane.

2. Description of Related Art

As the development and progress in wireless communication technologies continue to grow, various wireless communication products emerge and mobile phones become increasingly popular. Currently available mobile phones are commonly classified as bar-type, folder-type and slider-type. Among different types of mobile phone, since the system ground plane used in the mobile devices varies, the antenna applied thereto may be different as well. Taking the folder-type mobile phone as an example, compared to the bar-type mobile phone, the system ground plane thereof is formed by the upper-board ground plane and the main-board ground plane; therefore, if the antenna in the bar-type mobile phone is directly applied to the folder-type mobile phone, the antenna needs to be adjusted or re-designed, which may increase additional research and development costs. For example, the U.S. Pat. No. 6,750,821 B2, entitled "Folded Dual-Band Antenna Apparatus" discloses an antenna design applied in the bar-type mobile phone; however, if such an antenna is directly applied in a folder-type mobile phone, it is required to adjust the antenna parameters, causing undesirable increase in R&D costs.

SUMMARY OF THE INVENTION

In order to resolve the aforementioned drawbacks, the present invention proposes a mobile communication device which allows the antenna design originally applied in the bar-type mobile phone to be directly employed in the folder-type mobile phone. That is, effects of the upper-board ground plane of the folder-type mobile phone on the performances of the antenna will become negligible. Therefore, without modifying the design dimensions of the antenna, the antenna performances thereof can be similar to the ones found when originally applied to the bar-type mobile phone.

The mobile communication device according to the present invention comprises a dielectric substrate, a first ground plane, an antenna element, a second ground plane and an equivalent band-stop circuit. The first ground plane may be the ground plane of a main board in a folder-type mobile phone, formed on the dielectric substrate by etching or printing. The antenna element is disposed on or nearby the dielectric substrate and is electrically connected to a signal source located on the dielectric substrate. The second ground plane may be the ground plane of an upper board in the folder-type mobile phone, and is disposed in close proximity to one edge of the first ground plane and electrically connected to the first ground plane through a metal strip. The equivalent band-stop circuit may be disposed on the first ground plane or the second ground plane, comprising a slit whose open end being close to the metal strip, and a capacitive element mounted across the slit, with two ends of which capacitive element being electrically connected to two sides of the slit, respectively. The surface current distribution along the perimeter of the slit is in general very strong between the first ground plane and the second ground plane, so the slit is allowed to provide an equivalent feature of distributive inductance. The capacitive element is mounted across the two sides of the slit, and the capacitance value (C) provided thereby and the equivalent inductance value (L) provided by the slit can together form a parallel resonance at a specific frequency, thus enabling the band-stop effect, so such a feature can be equivalent to an equivalent band-stop circuit configured between the first ground plane and the second ground plane.

In such a case, the surface current distribution of the second ground plane excited by the antenna element can be significantly reduced, thereby greatly relieving the effect imposed by the second ground plane upon the performances of the antenna element.

DETAILED DESCRIPTION OF THE PREFERRED EMBODIMENTS

Figure 1:
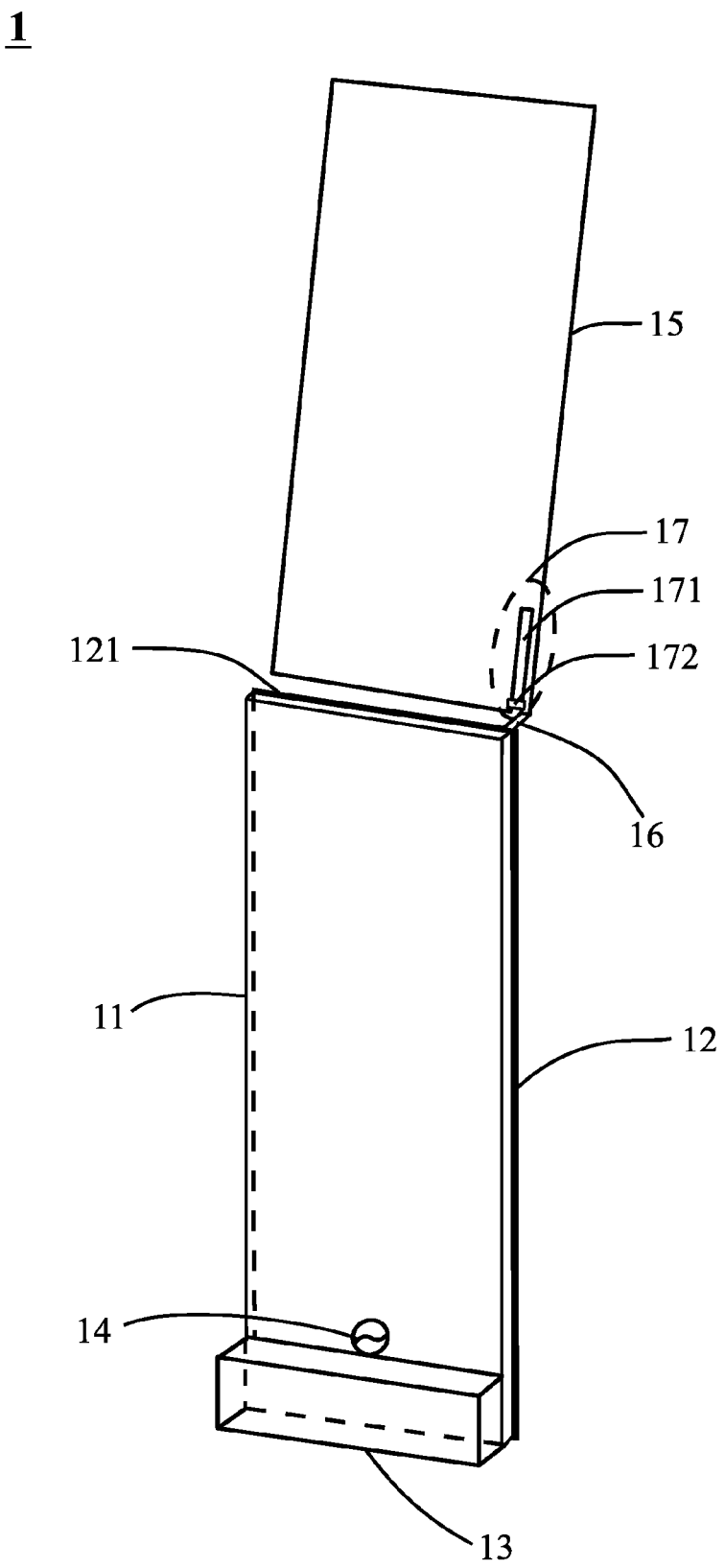
FIG. 1 is a structural diagram for a first embodiment of the mobile communication device according to the present invention.

FIG. 1 shows a structural diagram for a first embodiment 1 of the mobile communication device according to the present invention. The mobile communication device comprises a dielectric substrate 11, a first ground plane 12, an antenna element 13, a second ground plane 15 and an equivalent band-stop circuit 17. The first ground plane 12 is formed on the dielectric substrate 11 by means of etching or printing technique. The antenna element 13 is disposed on or nearby the dielectric substrate 11 and is electrically connected to a signal source 14 located on the dielectric substrate 11. The second ground plane 15 is disposed in close proximity to one edge 121 of the first ground plane and electrically connected to the first ground plane 12 through a metal strip 16. The equivalent band-stop circuit 17 is disposed on the second ground plane 15 and in vicinity of the metal strip 16 and comprises a slit 171 whose open end being close to the metal strip 16 and a capacitive element 172 mounted across the slit, with two ends of which capacitive element 172 being electrically connected to the two sides of the slit 171, respectively. The slit 171 is at least 0.3 mm in width, thereby providing the equivalent band-stop circuit 17 with a preferred equivalent inductance value.

Figure 2:
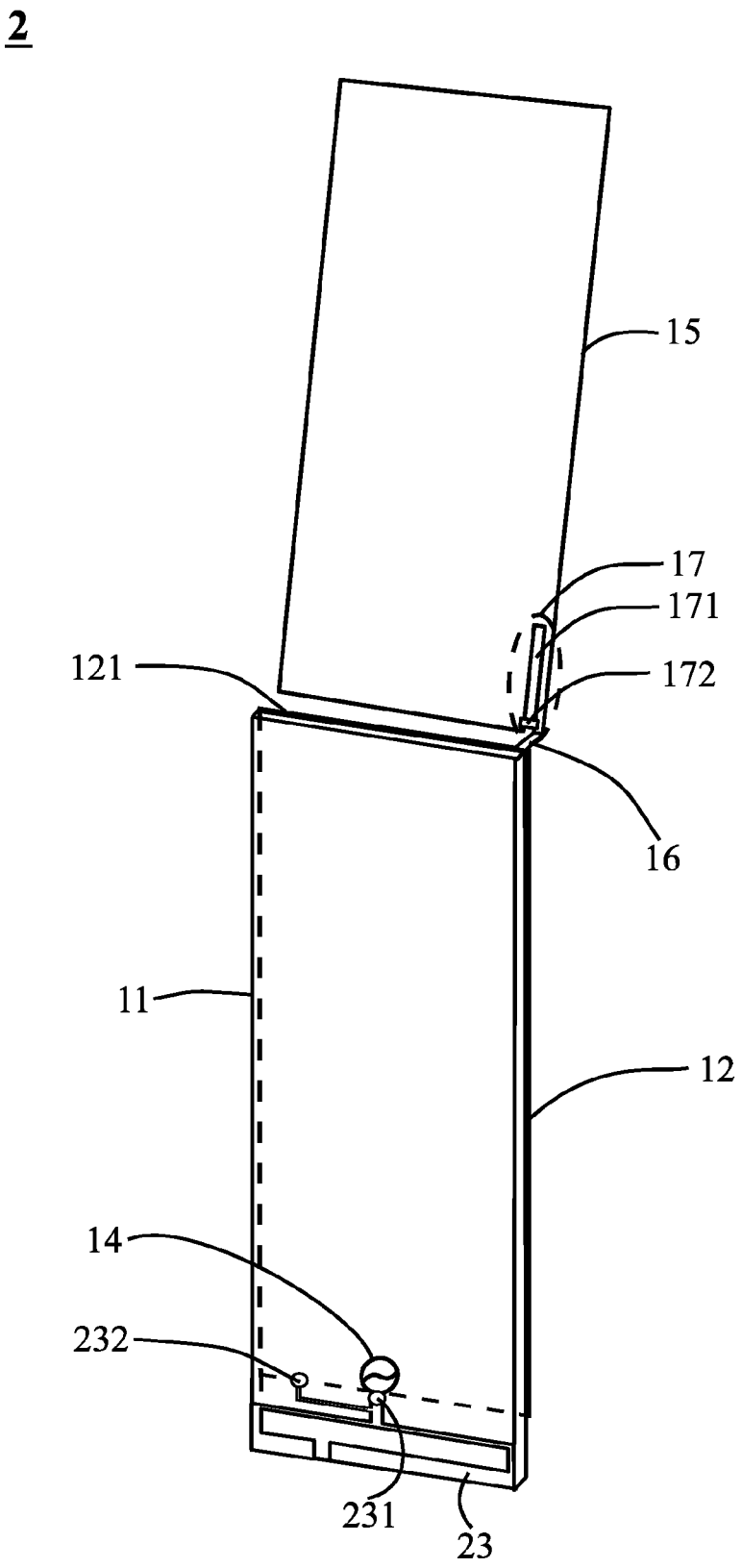
FIG. 2 is a structural diagram for a second embodiment of the mobile communication device according to the present invention.

FIG. 2 shows a structural diagram for a second embodiment 2 of the mobile communication device according to the present invention, whose structure is essentially identical to the one illustrated in the first embodiment, except that the antenna element 23 is a short-circuited monopole antenna, in which the antenna element 23 consists of an antenna feed point 231 and a shorting point 232. The antenna feed point 231 is electrically connected to a signal source 14 disposed on the dielectric substrate 11, and the shorting point 232 is electrically connected to the first ground plane 12.

Figure 3:
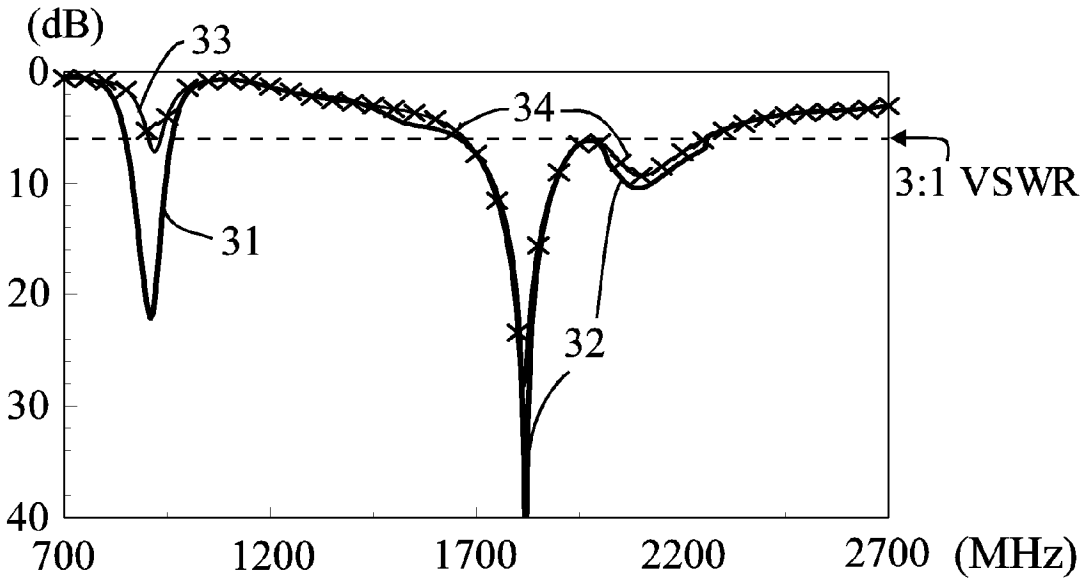
FIG. 3 is a diagram of return loss for the second embodiment of the mobile communication device according to the present invention.

FIG. 3 is a diagram of return loss for the second embodiment, wherein the axis of abscissa indicates the operating frequency, while the axis of ordinate represents the return loss. In the second embodiment, the first ground plane 12 is designated to have a length of approximately 100 mm, a width of about 45 mm, disposed on a glass fiber dielectric substrate 11 having a thickness of about 0.8 mm; the antenna element 23 to have an area of 15×45 $mm^2$, disposed on the glass fiber dielectric substrate 11; the second ground plane 15 to have an length of about 100 mm, a width of about 45 mm, electrically connected to the first ground plane 12 through a metal strip 16; the equivalent band-stop circuit 17 consisting of a slit 171 whose length is 15 mm and width is 2 mm and a capacitive element 172 which is a chip capacitor having a capacitance value of 2.7 pF. It can be seen from experimental results that, under the definition of 6 dB return loss, the first operating band 31 and the second operating band 32 for the second embodiment can respectively cover GSM 850/900 (824~960 MHz) frequency bands and GSM 1800/1900/UMTS (1710-2170 MHz) frequency bands. It is to be noted that in case of absence of the equivalent band-stop circuit 17 in the second embodiment, the feature of the antenna element 23 is more significantly affected by the second ground plane 15. From the results shown in FIG. 3, it can be observed that the bandwidth of the first operating band 33 is greatly reduced, thus incapable of covering GSM 850/900 frequency bands, while the second ground plane 34 is very slightly affected.

Figure 4:
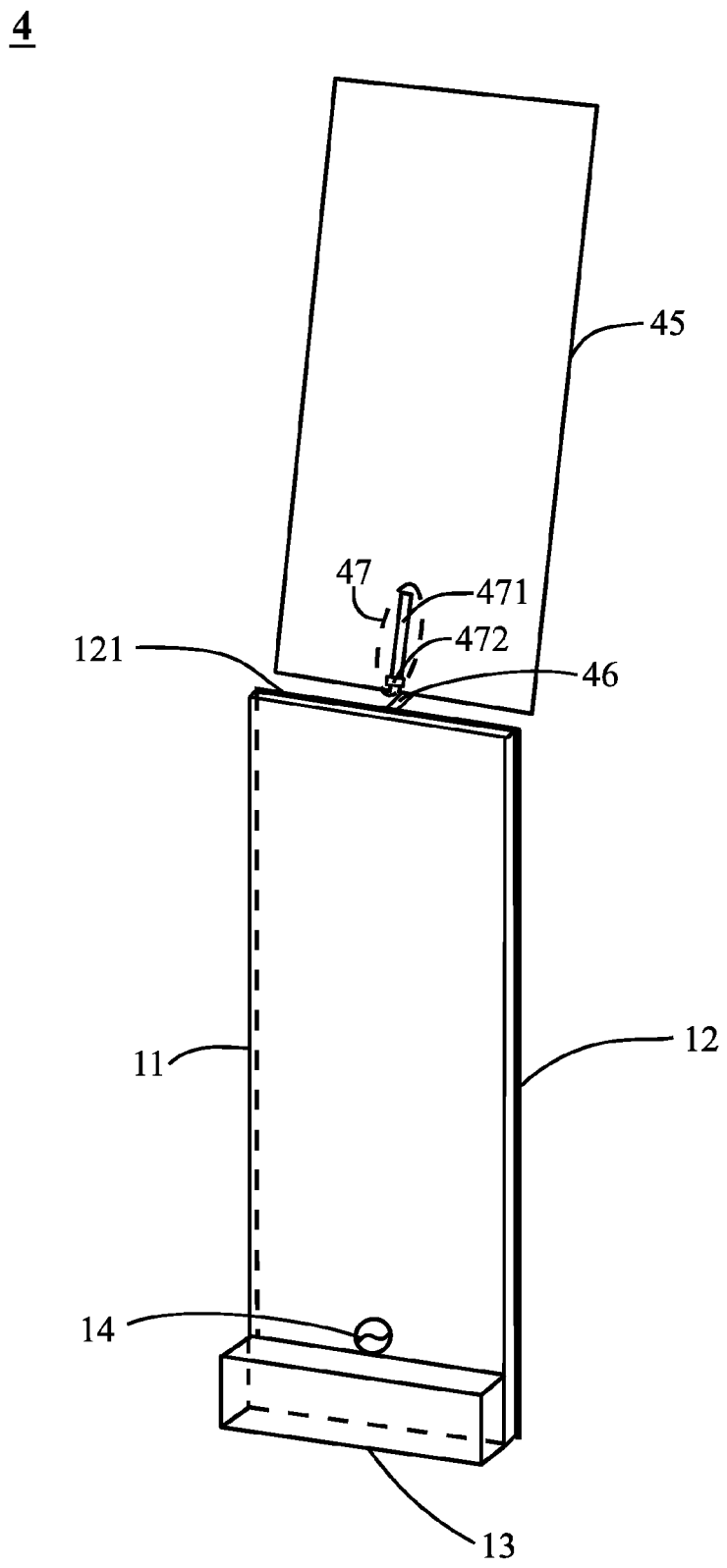
FIG. 4 is a structural diagram for a third embodiment of the mobile communication device according to the present invention.

FIG. 4 is a structural diagram for a third embodiment 4 of the mobile communication device according to the present invention, wherein the metal strip 46 and the equivalent band-stop circuit 47 are largely located at the central location of the second ground plane 45, but the equivalent band-stop circuit 47 is still disposed nearby the metal strip 46. Other portions of the present structure are similar to the counterparts in the first embodiment, and hence the third embodiment can also achieve an effect similar to the first embodiment.

Figure 5:
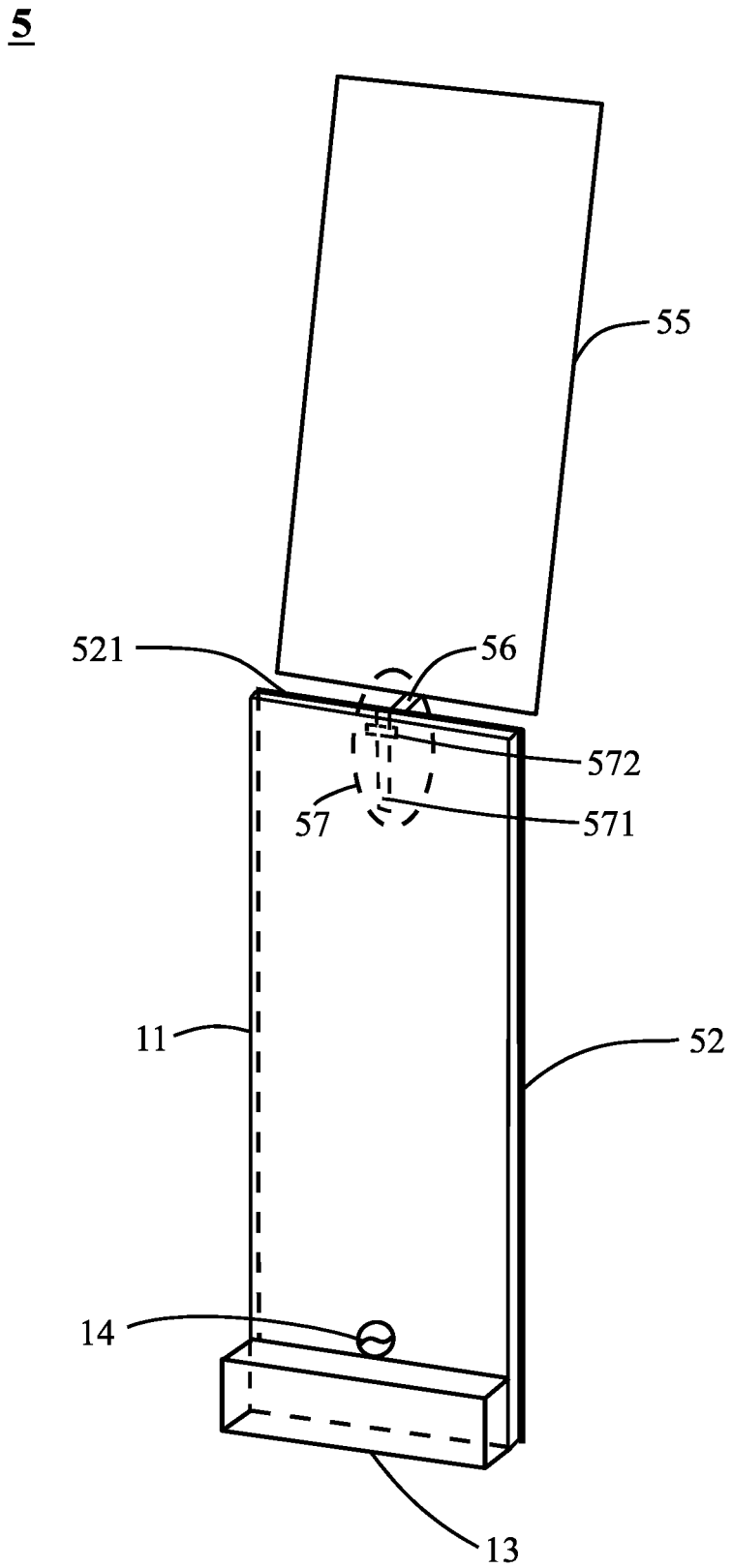
FIG. 5 is a structural diagram for a fourth embodiment of the mobile communication device according to the present invention.

FIG. 5 is a structural diagram for a fourth embodiment 5 of the mobile communication device according to the present invention, wherein the metal strip 56 and the equivalent band-stop circuit 57 are approximately located at the central location of the first ground plane 52, but the equivalent band-stop circuit 57 is still disposed nearby the metal strip 56. Other portions of the present structure are similar to the counterparts in the first embodiment, and hence the third embodiment can achieve an effect similar to the first embodiment as well.

The embodiments illustrated hereinbefore merely describe the principle of the present invention and effects thereof, rather than limiting the scope of the present invention thereto. Therefore, those skilled ones in the art can certainly perform changes and modifications to the aforementioned embodiments without departing from the spirit of the present invention. The scope of the present invention should thus be delineated in accordance with the claims set forth hereunder.

What is claimed is:

1. A mobile communication device, comprising:
a dielectric substrate;
a first ground plane disposed on the dielectric substrate;
an antenna element disposed on or nearby the dielectric substrate, the antenna element being electrically connected to a signal source located on the dielectric substrate;
a second ground plane disposed in close proximity to one edge of the first ground plane and electrically connected to the first ground plane through a metal strip; and
an equivalent band-stop circuit disposed on the second ground plane, comprising:
a slit having an open end being close to the metal strip, and a distance between the open end and the metal strip is smaller than a width of the slit; and
a capacitive element mounted across the slit, two ends of the capacitive element being electrically connected to two sides of the slit respectively.

2. The mobile communication device according to claim 1, wherein the first ground plane is formed on the dielectric substrate by etching or printing.

3. The mobile communication device according to claim 1, wherein the capacitive element is a chip capacitor.

4. The mobile communication device according to claim 1, wherein the capacitive element is disposed at the open end of the slit.

5. The mobile communication device according to claim 1, wherein the slit is at least 0.3 mm in width.

6. A mobile communication device, comprising:
a dielectric substrate;
a first ground plane disposed on the dielectric substrate;
an antenna element disposed on or nearby the dielectric substrate, the antenna element being electrically connected to a signal source located on the dielectric substrate;
a second ground plane disposed in close proximity to one edge of the first ground plane and electrically connected to the first ground plane through a metal strip; and
an equivalent band-stop circuit disposed on the first ground plane, comprising:
a slit having an open end being close to the metal strip, and a distance between the open end and the metal strip is smaller than a width of the slit; and
a capacitive element mounted across the slit, two ends of the capacitive element being electrically connected to two sides of the slit respectively.

7. The mobile communication device according to claim 6, wherein the first ground plane is formed on the dielectric substrate by etching or printing.

8. The mobile communication device according to claim 6, wherein the capacitive element is a chip capacitor.

9. The mobile communication device according to claim 6, wherein the capacitive element is disposed at the open end of the slit.

10. The mobile communication device according to claim 6, wherein the slit is at least 0.3 mm in width.

* * * * *